US010995761B2

(12) United States Patent
Hartmann

(10) Patent No.: US 10,995,761 B2
(45) Date of Patent: May 4, 2021

(54) RETURN STAGE

(71) Applicant: Siemens Aktiengesellschaft, Munich (DE)

(72) Inventor: Jörg Paul Hartmann, Dusseldorf (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 105 days.

(21) Appl. No.: 16/485,247

(22) PCT Filed: Jan. 22, 2018

(86) PCT No.: PCT/EP2018/051389

§ 371 (c)(1),
(2) Date: Aug. 12, 2019

(87) PCT Pub. No.: WO2018/153583

PCT Pub. Date: Aug. 30, 2018

(65) Prior Publication Data

US 2019/0368497 A1 Dec. 5, 2019

(30) Foreign Application Priority Data

Feb. 21, 2017 (EP) ..... 17157126

(51) Int. Cl.
*F04D 17/12* (2006.01)
*F04D 29/44* (2006.01)
*F01D 5/14* (2006.01)

(52) U.S. Cl.
CPC ..... *F04D 17/122* (2013.01); *F04D 29/444* (2013.01); *F01D 5/141* (2013.01); *F05D 2220/40* (2013.01); *F05D 2250/51* (2013.01)

(58) Field of Classification Search
CPC .... F04D 17/122; F04D 29/444; F01D 17/165; F01D 5/141
See application file for complete search history.

(56) References Cited

U.S. PATENT DOCUMENTS

2005/0220616 A1* 10/2005 Vogiatzis ..... F01D 9/02 415/208.1
2010/0272564 A1* 10/2010 Richter ..... F04D 17/122 415/208.1

(Continued)

FOREIGN PATENT DOCUMENTS

CA 1252075 A 4/1989
CN 104929696 A 9/2015

(Continued)

OTHER PUBLICATIONS

Jariwala, Vishal; Larosiliere, Louis; Hardin, James; "Design Exploration of a Return Channel for Multistage Centrifugal Compressors"; Proceedings of ASME Turbo Expo 2016: Turbomachinery Technical Conference and Exposition GT 2016, Jun. 13-17, 2016, Seoul, South Korea; GT 2016-57777; 2016.

(Continued)

*Primary Examiner* — Eldon T Brockman
*Assistant Examiner* — Michael K. Reitz

(57) ABSTRACT

A recirculation stage of a radial turbomachine, the recirculation stage has an inner delimiting contour and an outer delimiting contour. The stator vane stage has stator vanes, wherein a difference between a vane construction angle at the leading edge and a vane construction angle at a downstream position defines a redirection angle for each point on the camber line of a respective profile cross section, wherein the stator vanes extend at least along part of the third section, wherein the trailing edges are arranged in the third section, wherein at the trailing edges in the center of the span width the redirection angle is in each case greater than the average overall redirection angle, wherein at both ends of the span width at in each case at least 10% of the span width in each case the redirection angle is smaller than the average overall redirection angle.

6 Claims, 3 Drawing Sheets

(56) References Cited

U.S. PATENT DOCUMENTS

| | | | | |
|---|---|---|---|---|
| 2013/0280060 | A1* | 10/2013 | Nasir | F04D 29/444<br>415/208.2 |
| 2015/0086396 | A1* | 3/2015 | Nasir | F01D 17/165<br>417/407 |
| 2015/0300369 | A1* | 10/2015 | Sezal | F04D 29/444<br>415/1 |
| 2015/0345297 | A1 | 12/2015 | Neubrand et al. | |
| 2018/0347584 | A1* | 12/2018 | Larosiliere | F04D 17/06 |

FOREIGN PATENT DOCUMENTS

| | | | |
|---|---|---|---|
| DE | 3430307 | A1 | 4/1985 |
| DE | 102014203251 | A1 | 8/2015 |
| DE | 102014223833 | A1 | 5/2016 |
| EP | 0592803 | A1 | 4/1994 |
| JP | H11173299 | A | 6/1999 |
| WO | 2014072288 | A1 | 5/2014 |
| WO | 2016047256 | A1 | 3/2016 |

OTHER PUBLICATIONS

PCT International Search Report and Written Opinion of International Searching Authority dated Jul. 5, 2018 corresponding to PCT International Application No. PCT/EP2018/051389 filed Jan. 22, 2018.

* cited by examiner

RETURN STAGE

CROSS REFERENCE TO RELATED APPLICATIONS

This application is the US National Stage of International Application No. PCT/EP2018/051389 filed Jan. 22, 2018, and claims the benefit thereof. The International Application claims the benefit of European Application No. EP17157126 filed Feb. 21, 2017. All of the applications are incorporated by reference herein in their entirety.

FIELD OF INVENTION

The invention relates to a return stage of a radial turbomachine having at least one guide blade stage, wherein the return stage extends annularly around an axis, wherein the return stage is defined radially inwards by an inner delimiting contour and radially outwards by an outer delimiting contour, wherein, along a first flow direction, the return stage extends radially outwards in a first section, wherein the return stage extends from radially outwards to radially inwards, describing an arcuate deflection, in a second section along the first flow direction, wherein the return stage extends from radially outwards to radially inwards in a third section along the first flow direction, wherein the return stage extends from radially inwards to axially, describing an arcuate deflection, in a fourth section along the first flow direction, wherein the guide blade stage comprises guide blades, wherein the guide blades each comprise a turbine blade which extends along a span width and whereof the surfaces around which the flow circulates extend from a leading edge, located upstream, as a pressure side and as a suction side, spaced from one another along a camber line by profile cross-sections, to a trailing edge, wherein a tangent at the camber line of each profile cross-section to a radial-axial reference plane encloses a blade construction angle for each point of the camber line, wherein a difference between a blade construction angle at the leading edge and a blade construction angle at a downstream position defines a deflection angle for each point of the camber line of each profile cross-section, wherein a mean total deflection angle is a deflection angle at the trailing edge which is determined via the span width, wherein the guide blades extend at least along part of the third section and the return stage is segmented into flow channels in the circumferential direction, wherein the trailing edges are arranged in the third section.

BACKGROUND OF INVENTION

Radial turbomachines are known as either radial turbocompressors or radial turboexpanders. The embodiments below—unless stated otherwise—relate to the embodiment as a compressor. The invention can essentially apply to expanders as well as compressors, wherein a radial expander substantially provides a flow direction of the process fluid which is contrary to that of a radial turbocompressor.

In a radial turboexpander, with the expansion and deflection of a process fluid, a conversion of the thermodynamic energy accumulated in the process fluid into technical energy takes place by means of a drive of the impeller.

In radial turbocompressors, this procedure is reversed, these convert or accumulate technical energy into flow energy, which is thermodynamically accumulated in the process fluid. To this end, impellers of the compressor generally suction a process fluid axially with respect to a rotational axis or at an angle to the rotational axis with an axial velocity component and accelerate and compress this process fluid by means of the respective impeller, which deflects the flow direction of the process fluid into the radial direction. In a multi-stage radial turbocompressor, a return stage adjoins the impeller downstream when at least one further impeller is provided downstream.

Return stages of a multistage turbocompressor are described in each case in documents DE102014203251A1, DE 34 303 07 A1 and EP 592 803 B1. US 2010/0272564 A1 and WO2014072288A1 look at return stages in relation to aerodynamics.

WO2016047256 discloses a return stage, which has non-cylindrical guide blades. Deflection angles are not specified therein. Documents US 2010/272564 A1, DE 10 2014 223833 A1, JP H11 173299 A disclose aerodynamic embodiments of comparable configurations.

An analysis of complex guide blade geometries is revealed in the article "Design exploration of a return channel for multistage centrifugal compressors" from the conference "Proceedings of the ASME Turbo Expo", volume/year 2016, by authors Vishal Jariwala, Louis Larosiliere and James Hardin. The proposed guide blades extend in each case into the 90° deflection of the fourth section of the return stage in order to improve the homogeneity of the outflow with regard to the span width. Such return stages are difficult to manufacture and difficult to assemble.

SUMMARY OF INVENTION

Starting from this, the invention is based on an object of improving the aerodynamics of the return stages without having to accept such difficulties.

To achieve the object according to the invention, the invention proposes a return stage according to the independent claim. The subclaims contain advantageous further developments of the invention.

In this case, or in this document, the terms axial, radial, tangential, circumferential direction and the like each relate to the center axis around which the return stage extends annularly. In a radial turbomachine, this axis is also the rotational axis of a rotor or the shaft having the impellers.

Where the terms cylinder or cylindrical are used, the general mathematical understanding of the term is assumed by the invention. A plane curve in a plane is translated a fixed distance along a straight line, which is not contained in the starting plane. Every two corresponding points of the curves and the translated curve are connected by a line segment. The total of these parallel line segments forms the associated cylinder surface (see also Wikipedia definition (https://.de.wikipedia.org/wiki/Zylinder_(geometrie) #Allgemeiner_Zylinder). Accordingly, in the present case, the cylinder is not restricted to the form of a circular cylinder. With respect to a blade, a cylindrical design means that the blade is formed by individual profiles which are stacked along a stacking line—along a straight stacking line. In this case, it is irrelevant whether the blade extends along a contoured or curved flow channel or the flow channel is straight. The decisive factor is the linear extent in the span width direction of the blade, which leads to the description "cylindrical blade".

In the vocabulary of this invention, a multi-stage radial turbomachine means that a plurality of impellers are arranged to be rotatable around the same rotational axis. In this case, an impeller can be equated to a stage of the radial turbomachine. Owing to the multiple stages, it is a requirement that, in the case of the compressor, the process fluid flowing radially out of the impellers has to be guided back in the direction of the rotational axis and can flow back into the following impeller of the downstream stage with an axial velocity component. The flow guidance, which enables the process fluid to be returned in this way, is therefore known as the "return stage". In the case of the expander, the component can be designed identically and the flow through it is simply in the opposite direction.

In addition to the return of the process fluid in the direction of the rotational axis and the deflection of the flow direction of the process fluid in the axial direction, guide blades are also provided according to the invention in the return stages, which guide blades at least partially, or completely, neutralize swirl induced in the flow out of the upstream impeller or even induce swirl in the opposite direction for entering the next downstream stage.

An execution according to the invention of a return stage provides that this total component is supported and aligned, generally in a casing or other supporting device, by means of a so-called diaphragm by means of suitable supports. Furthermore, the return stage comprises a so-called blade root, which is fastened to the diaphragm with the guide blades explained above to form a return channel. The process fluid flows through the return channel to the next impeller inlet. In this structure, the guide blades have two functions. On the one hand, the guide blades have the aerodynamic function of inducing a counter-swirl in the process fluid to the extent that at least the swirl from the upstream stage is substantially compensated and, on the other hand, the guide blades have the mechanical task of fastening the blade root on the diaphragm in such a way that a reliable hold is ensured despite the dynamic load.

The guide blade stage located in the return stage comprises guide blades, which segment the annular form of the return stage into individual channels in the circumferential direction. These guide blades can essentially also have interruptions (split), but, according to the invention, are advantageously designed to be uninterrupted along the first flow direction. The guide blades have profiles which can also be configured two-dimensionally—angled accordingly. A two-dimensional configuration is possible, for example, when the annular channel of the return stage is cut along a center surface extending in the circumferential direction. This cut surface of an individual guide blade can be developed into a plane to give a two-dimensional configuration. A profile center line of the profiles of the guide blades which are stacked on top of one another can be generated by means of center points of inscribed circles in the profile. This profile center line is also referred to as a camber line below.

With the profile center line, a profile center line running coordinate or camber line running coordinate along the first flow direction can be defined along a mean height of the respective guide blade. The length of the guide blade along this coordinate is advantageously standardized to a total length 1 or 100%.

In the present case, the vertical direction of the guide blade is defined as the direction which is orientated perpendicularly to the flow direction—in particular to the first flow direction—and perpendicularly to the circumferential direction. The height of the blade or vertical direction is referred to as the span width or the span width direction of the blade in this document.

The profile center line of the guide blade immediately adjacent to the outer delimiting contour of the annular channel of the return stage is referred to here as the outer track of the guide blade and the profile center line of the profile cross-section of the guide blade which is located directly on the inner delimiting contour is referred to as the inner track of the guide blade. In this context, the outer delimiting contour of the return stage can also be referred to as the cover-plate-side delimiting contour, since an impeller provided with a cover plate has this cover plate on the side of the outer delimiting contour. The hub-side flow contour of the impeller is located opposite this on the inner delimiting contour of the return stage so that the inner delimiting contour of the return stage can also be referred to as the hub-side delimiting contour. Along the complex geometry of the return stage, the inner delimiting contour cannot always be regarded as lying radially further inward than the outer delimiting contour for the same positions along a mean flow line through the return stage, which means that alternative descriptions in this regard are expedient for better understanding.

According to the invention, the deflection angle in the center of the span width is greater in each case than the mean total deflection angle in each case with respect to the trailing edges of the guide blades. The advantageous knowledge of the invention consists in that, on the one hand, this shaping of the guide blades brings about an oncoming flow onto the following impeller which is favorable for the efficiency of the return stage and, on the other, is associated with a relatively low level of difficulty in terms of both manufacture and assembly. As a result of the fact that the leading edge is advantageously only arranged after the 180° deflection and the trailing edge is arranged upstream of the 90° deflection from the radially inwardly directed flow into the axially directed flow, the vaning is located substantially in a radially extending flow channel without mandatory axial components of the flow. The shape of the guide blade according to the invention advantageously prepares the flow to flow into the impeller after the 180-deflection and before the redirection into the axial direction so that a continuation of the guide blades into the downstream deflection in the axial direction is not necessary. Conventional guide blade shapes in the return stage either have to accept the unfavorable inhomogeneous flow distribution in the span width direction or continue in a complex manner into the deflections of the second section and/or fourth section of the return stage in order to ensure an advantageous oncoming flow onto the following impeller. However, the trailing edges, which are brought close to the impeller, bring about an unfavorable excitation of the impeller owing to the resultant inhomogeneities in the circumferential direction.

An advantageous further development of the invention provides that the trailing edges each describe a straight line. In this configuration, the differences in the deflection angle are advantageously realized by different curvatures of the camber lines of different profiles of the span width.

Another advantageous further development provides that the trailing edges are designed to be curved or angled. In this case, this refers—in other words—to non-linear embodiments of the trailing edges. In this case, the curvature of the trailing edges can be realized both in the circumferential direction and in the radial direction, and any combination of these offsets is moreover also conceivable.

Within this context, an advantageous further development of the invention provides that, at the two ends of the span width to in each case at least 7% of the span width, the camber lines of the profile cross-sections there are designed to be shorter than a mean camber line length. Such an embodiment can be achieved if, for example, in the case of a cylindrical blade or in the case of a non-cylindrical blade, the trailing edges in these two end regions of the span width are shortened or the turbine blade is cut away or cut off somewhat at this point. The minimum deflection essentially required according to the invention in the regions of the span width ends is thus achieved in a particularly cost-effective manner.

BRIEF DESCRIPTION OF THE DRAWINGS

The invention is explained in more detail below with the aid of a specific exemplary embodiment with reference to drawings, which show schematically.

DETAILED DESCRIPTION OF INVENTION

Figure 1:
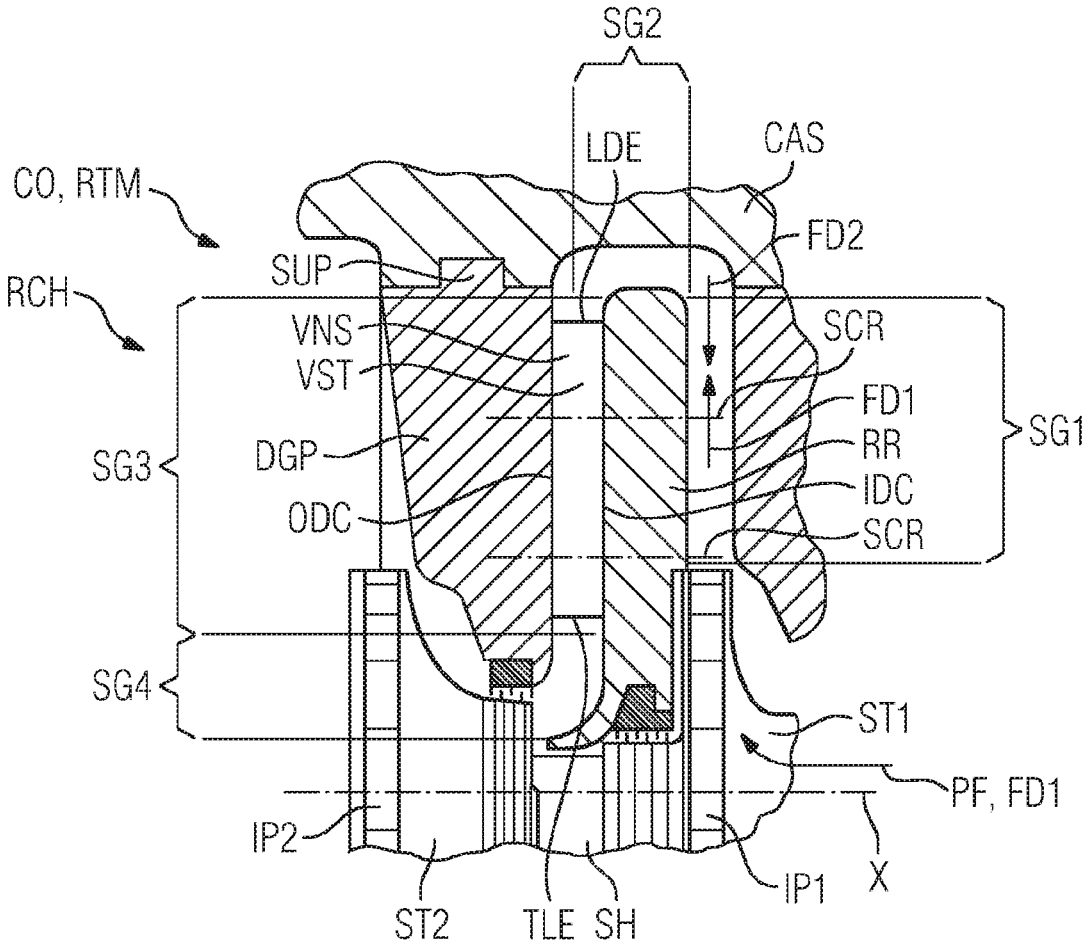
FIG. 1 an axial longitudinal section through the detail of a casing of a radial turbomachine with a return stage and impellers, FIG. 2 a schematic perspective illustration of a guide blade according to the invention, with different configurations of the trailing edge, FIG. 3 a schematic perspective illustration of a guide blade according to the invention, illustrated in association with a return stage according to the invention.

FIG. 1 shows a return stage RCH of a radial turbomachine RTM, which is designed as a radial turbocompressor CO.

The components explained here by way of example for a radial turbocompressor CO can also be implemented according to the invention as a radial turboexpander, wherein a process fluid PF flows through these components in a first flow direction FD1 in a radial turbocompressor CO and in an opposing second flow direction FD2 in a radial turboexpander. In this document, the depictions always relate to the first flow direction FD1 or a radial turbocompressor CO, unless stated otherwise.

FIG. 1 shows parts of two stages through which a flow successively passes; a first stage ST1 and a second stage ST2 of a radial turbomachine RTM, or radial turbo compressor CO, illustrated as a detail, wherein a return stage RCH between the two stages ST1, ST2 is illustrated fully schematically here. The two stages ST1, ST2 are illustrated here with impellers, a first impeller IP1 and a second impeller IP2, arranged to be rotatable about the rotational axis X.

In the illustration of FIG. 1, a process fluid PF flows along a first flow direction FD1, firstly flowing into the first impeller IP1 axially and flowing out radially. An opposingly aligned second flow direction FD2, such as would be the case for a radial expander, is also indicated merely by way of example. Downstream, after the first impeller IP1, the process fluid PF, flowing radially outwards, arrives at a radially outwardly directed first section SG1 and is delayed there, makes its way downstream to a ca. 180° deflection of a second section SG2 and subsequently into a radially inwardly directed return of a third section SG3 of the return stage RCH. Downstream of the third section SG3, the process fluid PF makes its way into a fourth section SG4, deflected from flowing radially inwards to flowing axially into the second impeller IP2 in order to be accelerated radially outwards again there.

The return stage RCH comprises a blade root RR, guide blades VNS and a diaphragm DGP. The diaphragm DGP is supported by means of at least one support SUP in a supporting device—here in a casing CAS—and positioned there. The support SUP and the supporting section of the casing CAS are designed with form fit here as a tongue and groove connection.

In a manner not illustrated in more detail, the return stage RCH or the blade root RR and the diaphragm DGP has/have a parting line which extends in a common plane substantially along the axis X. Expediently for assembly, this parting line is situated in the same parting line plane as a parting line (not illustrated) of the casing CAS.

It is essentially also conceivable that the rotor is designed such that it can be divided between two impellers or the impellers are designed to be axially displaceable with respect to one another for assembly purposes, so that the return stages RTC can be designed such that they are not divided and are assembled stepwise together with the impellers IP1, IP2 of the rotor before being combined with a surrounding casing. The casing CAS can be designed to be divided horizontally or vertically in each case.

The conventional design of the return stage RCH, which is shown in FIG. 1, provides that the blade root RR, the guide blades VNS and the diaphragm DGP are fastened to one another. In the present case, this is realized by means of screws SCR, which are illustrated in a simplified manner by dot and dash lines. So that, on the one hand, the screws SCR adequately fasten the blade root RR to the diaphragm DGP, and therefore have to have a minimum strength, a sufficiently long through bore has to be provided in the guide blades on the other, which means that the profile of the guide blades VNS has to be designed with sufficient strength.

Figure 2:
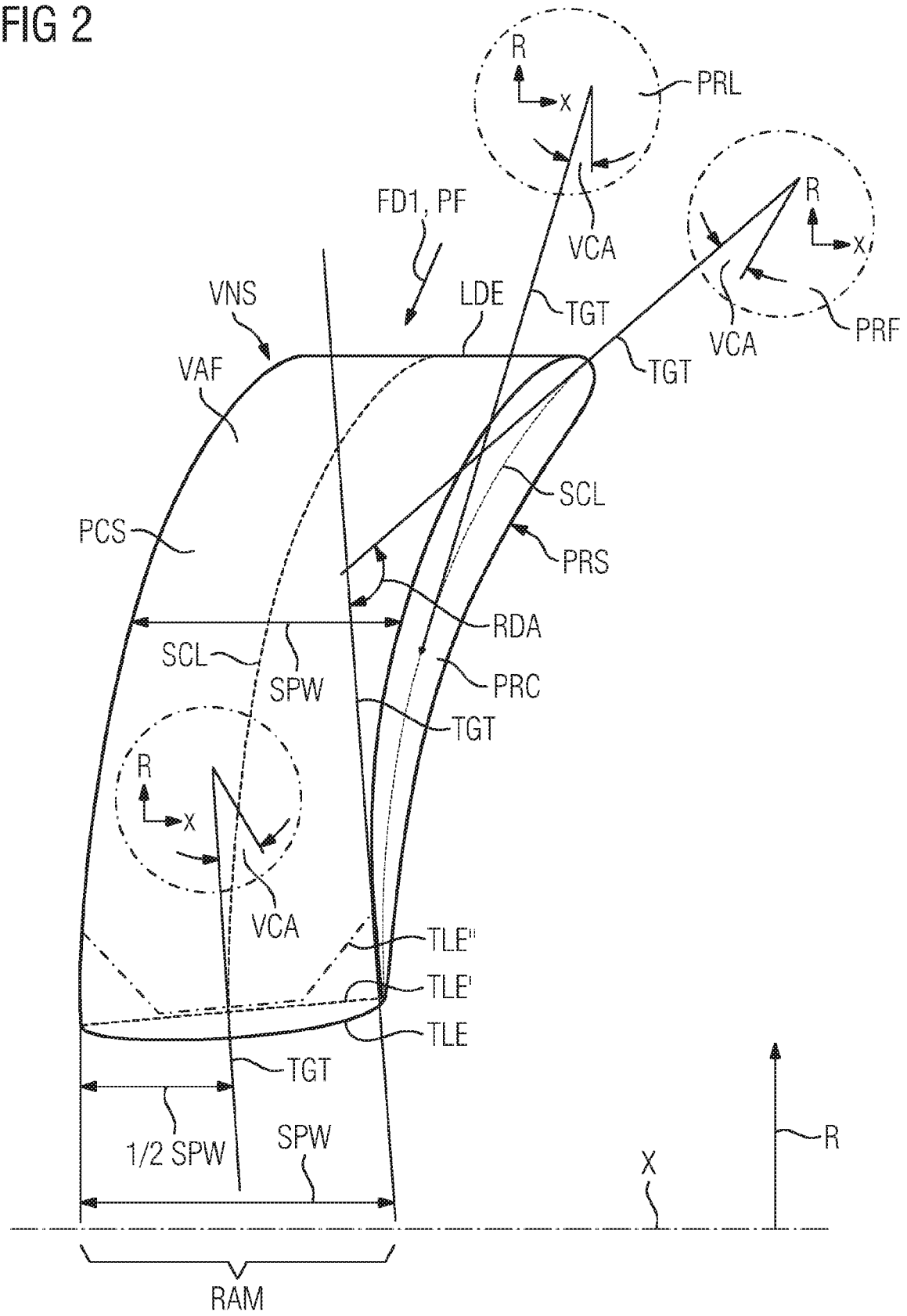

FIG. 2 shows a schematic perspective illustration of a guide blade VNS of a return stage RCH according to the invention. The guide blade VNS is illustrated in connection with the axis X and a radial direction R perpendicular thereto. In FIG. 2, a reference plane PRF, which is spanned by the axis X and the radial direction R, is indicated at different points in order to illustrate geometrical associations.

The guide blade VNS comprises a turbine blade VAF which extends along a span width SPW and whereof the surfaces SFT around which the flow circulates extend from the leading edge LDE, located upstream, as a pressure side PRS and as a suction side PCS, spaced from one another along a camber line (SCL) by profile cross-sections PRC, to a trailing edge (TLE). At the end of the span width, two tangents TGT are shown at the camber line SCL and, midway along the span width ½SPW, a tangent TGT at the camber line SCL indicates that, for each profile cross-section PRC, a blade construction angle VCR with respect to the radial-axial reference plane PRF is defined for each point of the camber line SCL. A difference between the blade construction angle VCA at the leading edge LDE and a blade construction angle VCA at a downstream position defines a deflection angle RDA here (RDA(SPW,SCL))=VCA(SPW, SCL=LDE)−VCA(SPW,SCL)) for each point of the camber line SCL. From this, a mean total deflection angle RAM, as deflection angle RDA established via the span width SPW, can be determined at the trailing edge TLE.

In addition to a curved trailing edge TLE, FIG. 2 also shows a linear trailing edge TLE' and an angled trailing edge TLE" which is provided with two angled portions and is produced by continuous cutting or continuous omission of portions of the original turbine blade VAF in the two end regions of the span width SPW.

Figure 3:
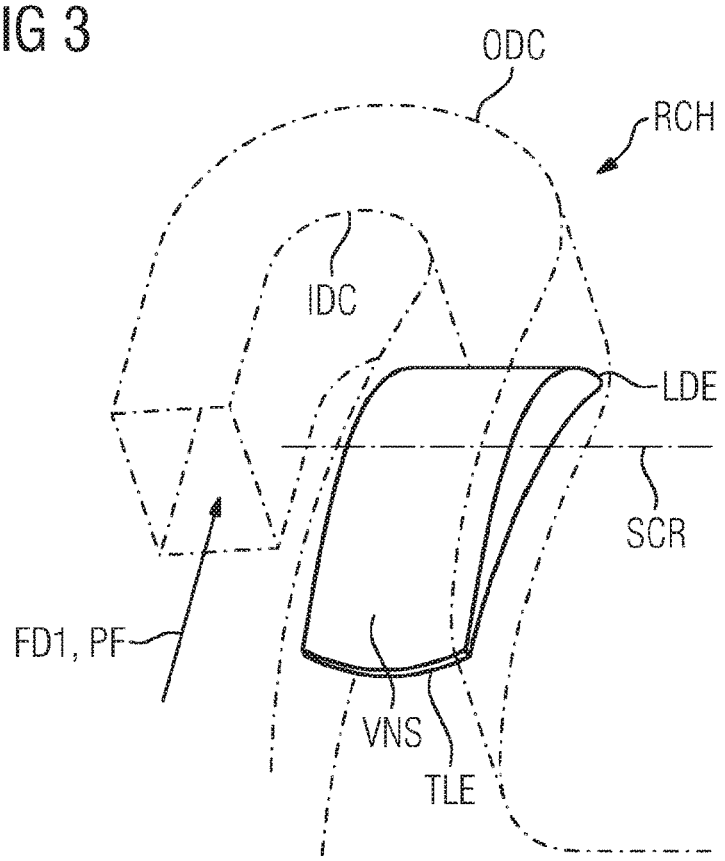

FIG. 3 shows an integrated guide blade VNS of a return stage RCH according to the invention. The region in which the guide blade VNS is provided in the return stage RCH extends substantially from radially outwards to radially inwards along the first flow direction FD1 of the process fluid PF. To fasten the arrangement, a screw SCR extends through the turbine blade VAF in the span width direction.

Figure 4:
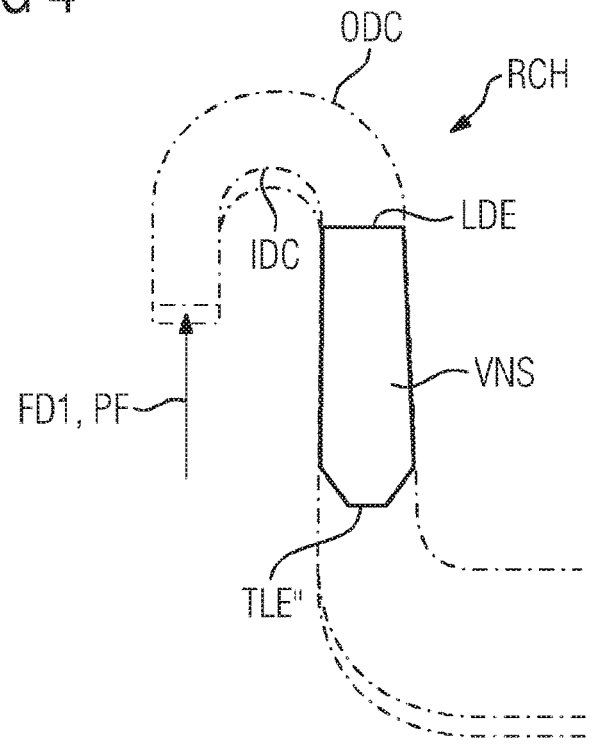
FIG. 4 a schematic perspective illustration of another embodiment of a guide blade according to the invention, with the associated return stage.

FIG. 4 shows the same situation as FIG. 3, with a different design of the guide blade VNS. The guide blade VNS of FIG. 4 is designed to be cylindrical and has cut-back regions of the trailing edge TLE" at both ends of the span width SPW. This embodiment corresponds to the illustration of a (TLE") of the three alternatives in FIG. 2.

The invention claimed is:

1. A return stage of a radial turbomachine having at least one guide blade stage, wherein the return stage extends annularly around an axis, wherein the return stage is defined radially inwards by an inner delimiting contour and radially outwards by an outer delimiting contour, wherein, along a first flow direction, the return stage extends radially outwards in a first section, wherein the return stage extends from radially outwards to radially inwards, describing an arcuate deflection, in a second section along the first flow direction, wherein the return stage extends from radially outwards to radially inwards in a third section along the first flow direction, wherein the return stage extends from radially inwards to axially, describing an arcuate deflection, in a fourth section along the first flow direction, wherein the return stage comprises guide blades, wherein the guide blades each comprise a turbine blade which extends along a span width and whereof the surfaces around which the flow circulates extend from a leading edge, located upstream, as a pressure side and as a suction side, spaced from one another along a camber line by profile cross-sections, to a trailing edge, wherein a tangent at the camber line of each profile cross-section to a radial-axial reference plane encloses a blade construction angle for each point of the camber line, wherein a difference between a blade construction angle at the leading edge and a blade construction angle at a downstream position defines a deflection angle for each point of the camber line of each profile cross-section, wherein a mean total deflection angle is a deflection angle at the trailing edge which is determined via the span width, wherein the guide blades extend at least along part of the third section and the return stage is segmented into flow channels in the circumferential direction, wherein the trailing edges are arranged in the third section, wherein, at the trailing edges in the center of the span width, the deflection angle is greater in each case than the mean total deflection angle, wherein, at the two ends of the span width to at least 10% of the span width in each case, the deflection angle is smaller in each case than the mean total deflection angle.

2. The return stage according to claim 1, wherein the leading edges are each arranged in the third section.

3. The return stage according to claim 1, wherein the trailing edges each describe a straight line.

4. The return stage according to claim 1, wherein the leading edges are designed to be curved or angled.

5. The return stage according to claim 1, wherein, at the two ends of the span width to at least 7% of the span width in each case, the camber lines of the profile cross-sections there are shorter than a mean camber line length.

6. The return stage according to claim 1, wherein the guide blades have a linear leading edge and are designed to be substantially cylindrical up to the region at the two ends of the span width, wherein, at the trailing edges to at least 7% of the span width in each case, the camber lines of the profile cross-sections there are designed to be shorter than a mean camber line length.

* * * * *